US008531367B2

(12) United States Patent
Son

(10) Patent No.: US 8,531,367 B2
(45) Date of Patent: Sep. 10, 2013

(54) LIQUID CRYSTAL DISPLAY DEVICE AND DRIVING METHOD THAT INCREASES TRASMITTANCE

(75) Inventor: Hyeon Ho Son, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 1125 days.

(21) Appl. No.: 11/798,126

(22) Filed: May 10, 2007

(65) Prior Publication Data

US 2007/0296666 A1 Dec. 27, 2007

(30) Foreign Application Priority Data

Jun. 9, 2006 (KR) ..... 10-2006-0051975

(51) Int. Cl.
*G09G 3/36* (2006.01)

(52) U.S. Cl.
USPC ..... 345/88

(58) Field of Classification Search
USPC ..... 345/87–111, 600, 613, 694; 362/231
See application file for complete search history.

(56) References Cited

U.S. PATENT DOCUMENTS

2002/0060662 A1* 5/2002 Hong ..... 345/102
2002/0180688 A1* 12/2002 Drzaic et al. ..... 345/107
2003/0184571 A1* 10/2003 Hirayama ..... 345/695
2004/0223005 A1* 11/2004 Lee ..... 345/690
2005/0140636 A1* 6/2005 Chung et al. ..... 345/98
2005/0225575 A1* 10/2005 Brown Elliott et al. ..... 345/694
2005/0243100 A1* 11/2005 Childers ..... 345/589
2006/0061605 A1* 3/2006 Credelle ..... 345/694
2006/0072058 A1* 4/2006 Rho ..... 349/144
2007/0064422 A1* 3/2007 Murai ..... 362/231
2007/0205972 A1* 9/2007 Asao et al. ..... 345/88
2009/0058873 A1* 3/2009 Brown Elliott et al. ..... 345/589

* cited by examiner

*Primary Examiner* — Chanh Nguyen
*Assistant Examiner* — Sanghyuk Park
(74) *Attorney, Agent, or Firm* — Morgan, Lewis & Bockius LLP

(57) ABSTRACT

A liquid crystal display device includes a display panel including one or more pixel region partitioned into first, second and third sub-pixels; a backlight including first and second sources for projecting onto the one or more pixel region one of a first light having a first wavelength and a second light having a second wavelength; and a controller for partitioning a four-color pixel data corresponding to a period into first and second data to be applied to the first and second sub-pixels, respectively, during a first part of the period while the backlight projects the first light onto the one or more pixel region, and third and fourth data to be applied to the first and second sub-pixels, respectively, during a second part of the period while the backlight projects the second light onto the one or more pixel region, the controller applying a white data to the third sub-pixel during the first and second parts of the period.

11 Claims, 15 Drawing Sheets

LIQUID CRYSTAL DISPLAY DEVICE AND DRIVING METHOD THAT INCREASES TRASMITTANCE

This application claims the benefit of Korean Patent Application No. 10-2006-051975 filed in Korea on Jun. 9, 2006, which is hereby incorporated by reference in its entirety.

BACKGROUND OF THE INVENTION

1. Field of the Invention

Embodiments of the present invention relate to a liquid crystal display (LCD) device, and more particularly to a method of driving the LCD device. Embodiments of the present invention are suitable for a wide scope of applications. In particular, embodiments of the present invention are suitable for increasing a light transmittance without distorting a color of the LCD device.

2. Description of the Related Art

Generally, an LCD device controls light transmittance of liquid crystal cells in accordance with video signals to thereby display a picture. An active matrix LCD device uses a switching device at each liquid crystal cell to improve the ability of displaying moving picture. The switching device used for the active matrix LCD device can be a thin film transistor ("TFT") as shown in FIG. 1.

Referring to FIG. 1, the active matrix LCD device converts a digital input data into an analog data voltage in accordance with a gamma reference voltage and supplies the analog data to a data line DL. Concurrently, the active matrix LCD device supplies a scanning pulse to a gate line GL, thereby charging a liquid crystal cell Clc.

A gate electrode of the TFT is connected to the gate line GL, a source electrode is connected to the data line DL, and a drain electrode of the TFT is connected to a pixel electrode of the liquid crystal cell Clc and one terminal of a storage capacitor Cst. A common electrode of the liquid crystal cell Clc is supplied with a common voltage Vcom.

When the TFT is turned-on, the storage capacitor Cst charges a data voltage applied from the data line DL to maintain a constant voltage at the liquid crystal cell Clc. If the gate pulse is applied to the gate line GL, the TFT is turned-on to define a channel between the source electrode and the drain electrode, thereby supplying a voltage on the data line DL to the pixel electrode of the liquid crystal cell Clc. In this case, liquid crystal molecules of the liquid crystal cell Clc are arranged by an electric field between the pixel electrode and the common electrode to modulate an incident light.

FIG. 2 is a block diagram showing a configuration of the related art LCD device. Herein, R represents red, G represents green, B represents blue, C represents cyan, W represents white, M represents magenta, and Y represents yellow. Referring to FIG. 2, an LCD device 100 includes an LCD panel 110 with a thin film transistor (TFT) driving the liquid crystal cell Clc at an crossing of data lines DL1 to DLm and gate lines GL1 to GLn crossing each other, a data driver 120 supplying a data to the data lines DL1 to DLm of the LCD panel 110, a gate driver 130 supplying a scanning pulse to the gate lines GL1 to GLn of the LCD panel 110, a gamma reference voltage generator 140 providing a gamma reference voltage to the data driver 120, a backlight assembly 150 irradiating a light onto the LCD panel 110, an inverter 160 applying an alternating current voltage and a current to the backlight assembly 150, a common voltage generator 170 providing a common voltage Vcom to the common electrode of the liquid crystal cell Clc of the LCD panel 110, a gate driving voltage generator 180 providing a gate high voltage VGH and a gate low voltage VGL to the gate driver 130, and a timing controller 190 controlling the data driver 120 and the gate driver 130.

The timing controller 190 supplies a digital video data RGB supplied from a system to the data driver 120. Furthermore, the timing controller 190 generates a data driving control signal DDC and a gate driving control signal GDC using horizontal/vertical synchronizing signals H and V in response to a clock signal CLK to supply them to the data driver 120 and the gate driver 130, respectively. Herein, the data driving control signal DDC includes a source shift clock SSC, a source start pulse SSP, a polarity control signal POL and a source output enable signal SOE, etc. The gate driving control signal GDC includes a gate start pulse GSP and a gate output enable signal GOE, etc.

The LCD panel 110 has a liquid crystal material formed between two glass substrates (not shown). On the lower glass substrate of the LCD panel 110, the data lines DL1 to DLm and the gate lines GL1 to GLn perpendicularly cross each other. Each crossing of the data lines DL1 to DLm and the gate lines GL1 to GLn is provided with the TFT. The TFT supplies a data on the data lines DL1 to DLm to the liquid crystal cell Clc in response to the scanning pulse. The gate electrode of the TFT is connected to the gate lines GL1 to GLn while the source electrode thereof is connected to the data line DL1 to DLm. Further, the drain electrode of the TFT is connected to the pixel electrode of the liquid crystal cell Clc and to the storage capacitor Cst.

The TFT is turned-on in response to the scanning pulse applied, via the gate lines GL1 to GLn, to the gate terminal thereof. Upon turning-on of the TFT, the video data on the data lines DL1 to DLm is supplied to the pixel electrode of the liquid crystal cell Clc. The data driver 120 supplies a data to the data lines DL1 to DLm in response to the data driving control signal DDC supplied from the timing controller 190. Further, the data driver 120 samples and latches the digital video data RGB from the timing controller 190, and then converts it into an analog data voltage capable of representing a gray level at the liquid crystal cell Clc of the LCD panel 110 on the basis of the gamma reference voltage supplied from the gamma reference voltage generator 140, thereby supplying it the data lines DL1 to DLm.

The gate driver 130 sequentially generates the scanning pulse, that is, the gate pulse in response to the gate driving control signal GDC and the gate shift clock GSC supplied from the timing controller 190 to supply them to the gate lines GL1 to GLn. In this case, the gate driver 130 determines a high level voltage and a low level voltage of the scanning pulse in accordance with the gate high voltage VGH and the gate low voltage VGL supplied from the gate driving voltage generator 180.

The gamma reference voltage generator 140 receives a high-level power voltage VDD to generate a positive gamma reference voltage and a negative gamma reference voltage and output them to the data driver 120.

The backlight assembly 150 is provided at the rear side of the LCD panel 110, and is radiated by an alternating current voltage and a current supplied from the inverter 160 to irradiate a light onto each pixel of the LCD panel 110.

The inverter 160 converts an internally generated square wave signal into a triangular wave signal, and then compares the triangular wave signal with a direct current (DC) power voltage VCC externally supplied to generate a burst dimming signal proportional to the result. If the burst dimming signal determined in accordance with the rectangular wave signal of the interior of the inverter 160 is generated, then a driving integrated circuit IC (not shown) controlling a generation of the AC voltage and a current within the inverter 160 controls a generation of AC voltage and current supplied to the backlight assembly 150 in accordance with the burst dimming signal.

The common voltage generator 170 receives a high-level power voltage VDD to generate the common voltage Vcom and supplies it to the common electrode of the liquid crystal cell Clc provided at each pixel of the LCD panel 110.

The gate driving voltage generator 180 is supplied with the high-level power voltage VDD to generate the gate high voltage VGH and the gate low voltage VGL, and supplies them to the gate driver 130. Herein, the gate driving voltage generator 180 generates a gate high voltage VGH greater than a threshold voltage of the TFT provided at each pixel of the LCD panel 110 and a gate low voltage VGL less then the threshold voltage of the TFT. The gate high voltage VGH and the gate low voltage VGL generated in this manner are used for determining a high level voltage and a low level voltage of the scanning pulse generated by the gate driver 130, respectively.

The LCD having such configurations and functions can be implemented using a variety of driving methods depending on whether or which color filter is used in the LCD panel and the type of light source applied to the LCD panel 110. A first related art the LCD device 100 uses R, G, and B color filters. In the first related LCD device, each pixel is partitioned into an R sub-pixel, a G sub-pixel, and a B sub-pixel using R, G, and B color filters in the LCD panel 110. Thus, in the first related art LCD device 100, a white lamp generating only white light is used as a light source for the backlight. Accordingly, white light irradiated from the white lamp is spatially divided by the R, G, and B color filters amongst the R, G and B sub-pixels. Accordingly, about 30% of the light from the backlight is irradiated by each of the R, G, and B color filters through the corresponding R, G or B sub-pixel.

A second related art LCD device 100 does not use a color filter in the LCD panel and uses a Field sequential (FS) driving method for color implementation. In the second related art LCD device 100, the pixels are not spatially divided into R, G and B sub-pixels. Thus, an R light source, a G light source, and a B light source are provided in the backlight of the LCD device 100. The R light source generates an R light, the G light source generates a G light, and the B light source generates a B light, respectively. Since the pixels are not spatially divided into color sub-pixels, the LCD device 100 performs a time division by sequentially irradiating the R light, the G light, and the B light to display R, G, and B colors, respectively. Moreover, because the pixels are not spatially divided into color sub-pixels, the FS driving method provides about 100% transmittance for each of the R light, the G light, and the B light. Furthermore, the LCD device 100 of the FS driving method provides a higher aperture ratio than the first related art LCD device.

A third related art LCD device 100 uses G and M color filters in the LCD panel for color implementation. In the third related art LCD device, each pixel is divided into a G sub-pixel and an M sub-pixel using G and M color filters provided within the LCD panel 110. Thus, in the LCD device 100, the backlight includes a C light source and a Y light source generating a C light and a Y light, respectively. Moreover, each frame is divided into first and second subframes sequentially displayed. Thus, if the frames are driven at a driving frequency of about 60 Hz, the corresponding first and second subframes are driven at a frequency of about 120 Hz.

During the first subframe, the third related art LCD device 100 supplies a C data and a B data to the G sub-pixel and the M sub-pixel, respectively, and irradiates a C light onto the G sub-pixel and the M sub-pixel. Thus, each of the G and M filters transmits 50% of the incident light during the first subframe.

During the second subframe, the third related LCD device 100 supplies a G data and an R data to the G sub-pixel and the M sub-pixel, respectively, and at the same time irradiates a Y light into the G sub-pixel and the M sub-pixel. Thus, each of the G and M filters transmits 50% of the incident light during the second subframe.

Thus, by reducing the number of color filters in the LCD panel, a light transmittance and an aperture ratio are improved. Moreover, when the R, G, and B color filters are used, one frame is divided into three subframes. Accordingly, the three subframes are driven at a frequency of about 180 Hz. On the other hand, when only the G and M color filters are used, each frame is divided into two subframes. Accordingly, the two subframes are driven at a driving frequency of about 120 Hz. Thus, the subframes in LCD panel using G and M color filters can be driven at a reduced frequency. However, a light transmittance of the G sub-pixel and the M sub-pixel needs be improved.

SUMMARY OF THE INVENTION

Accordingly, embodiments of the present invention are directed to liquid crystal display device and a driving method thereof that substantially obviate one or more problems due to limitations and disadvantages of the related art.

An object of the present invention is to increase a light transmittance of a liquid crystal display device.

Another object of the present invention is to increase a brightness of a liquid crystal display device.

Additional features and advantages of the invention will be set forth in the description of exemplary embodiments which follows, and in part will be apparent from the description of the exemplary embodiments, or may be learned by practice of the exemplary embodiments of the invention. These and other advantages of the invention will be realized and attained by the structure particularly pointed out in the written description of the exemplary embodiments and claims hereof as well as the appended drawings.

To achieve these and other advantages and in accordance with the purpose of the present invention, as embodied and broadly described, a liquid crystal display device includes a display panel including one or more pixel region partitioned into first, second and third sub-pixels; a backlight including first and second sources for projecting onto the one or more pixel region one of a first light having a first wavelength and a second light having a second wavelength; and a controller for partitioning a four-color pixel data corresponding to a period into first and second data to be applied to the first and second sub-pixels, respectively, during a first part of the period while the backlight projects the first light onto the one or more pixel region, and third and fourth data to be applied to the first and second sub-pixels, respectively, during a second part of the period while the backlight projects the second light onto the one or more pixel region, the controller applying a white data to the third sub-pixel during the first and second parts of the period.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of embodiments of the present invention and are incorporated in and constitute a part of this application, illustrate embodiments of the present invention and together with the description serve to explain the principle of embodiments of the present invention. In the drawings.

DETAILED DESCRIPTION OF EXEMPLARY EMBODIMENTS

Hereinafter, exemplary embodiments of the present invention will be described in detail with reference to the accompanying drawings.

Figure 1:
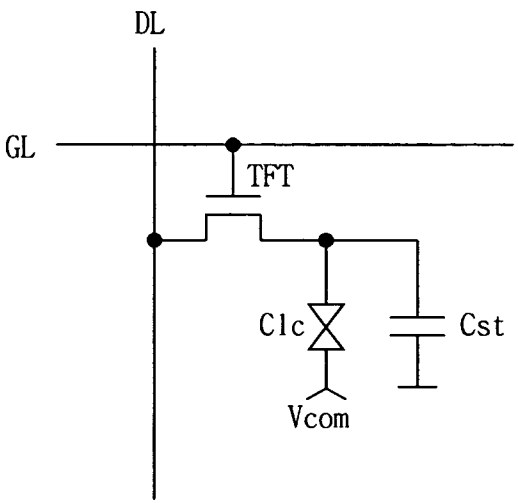
FIG. 1 RELATED ART
FIG. 1 is an equivalent circuit diagram showing a pixel provided at a related art LCD.
Figure 2:
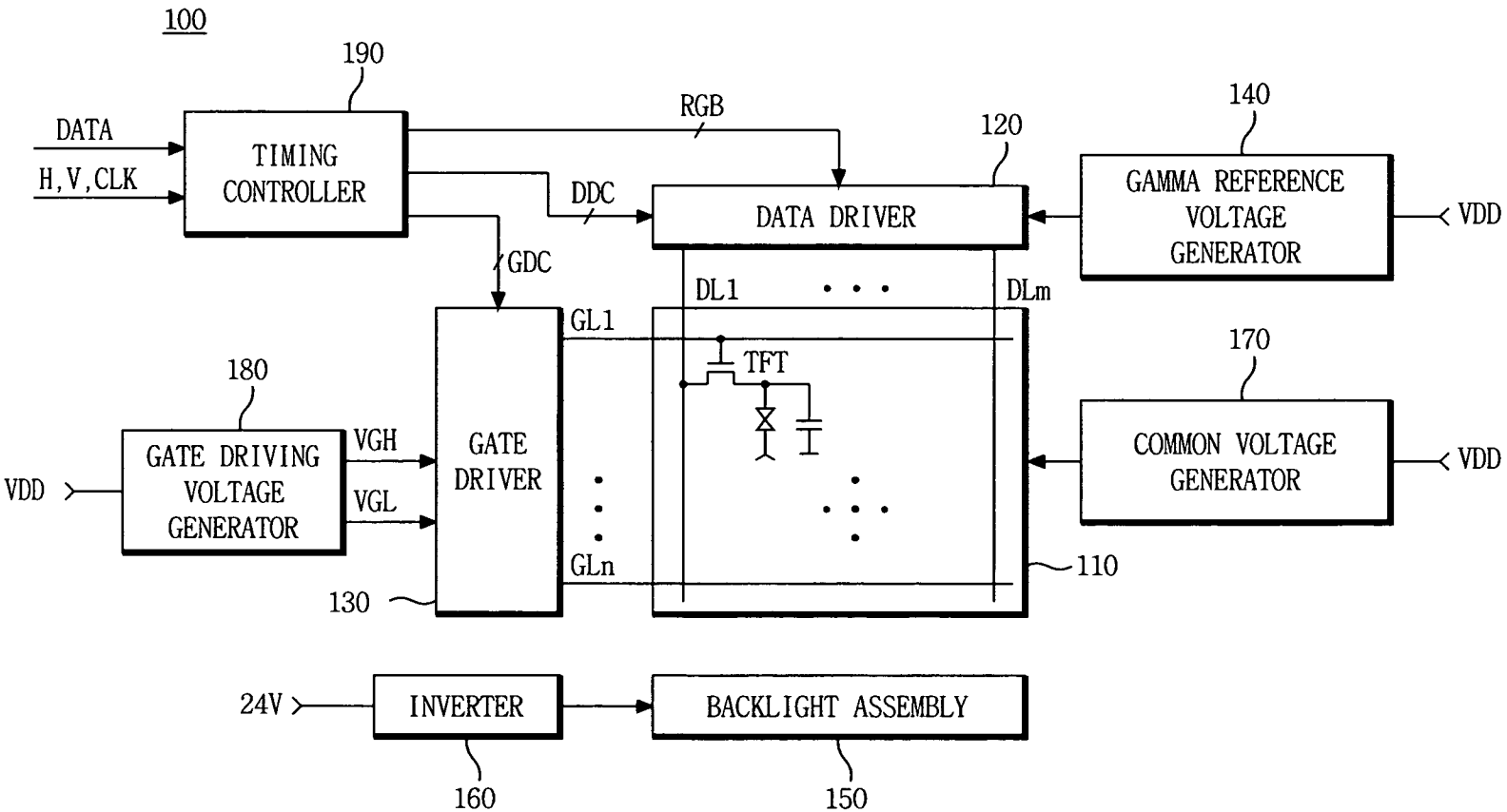
FIG.2 RELATED ART
FIG. 2 is a block diagram showing a configuration of the related art LCD.
Figure 3:
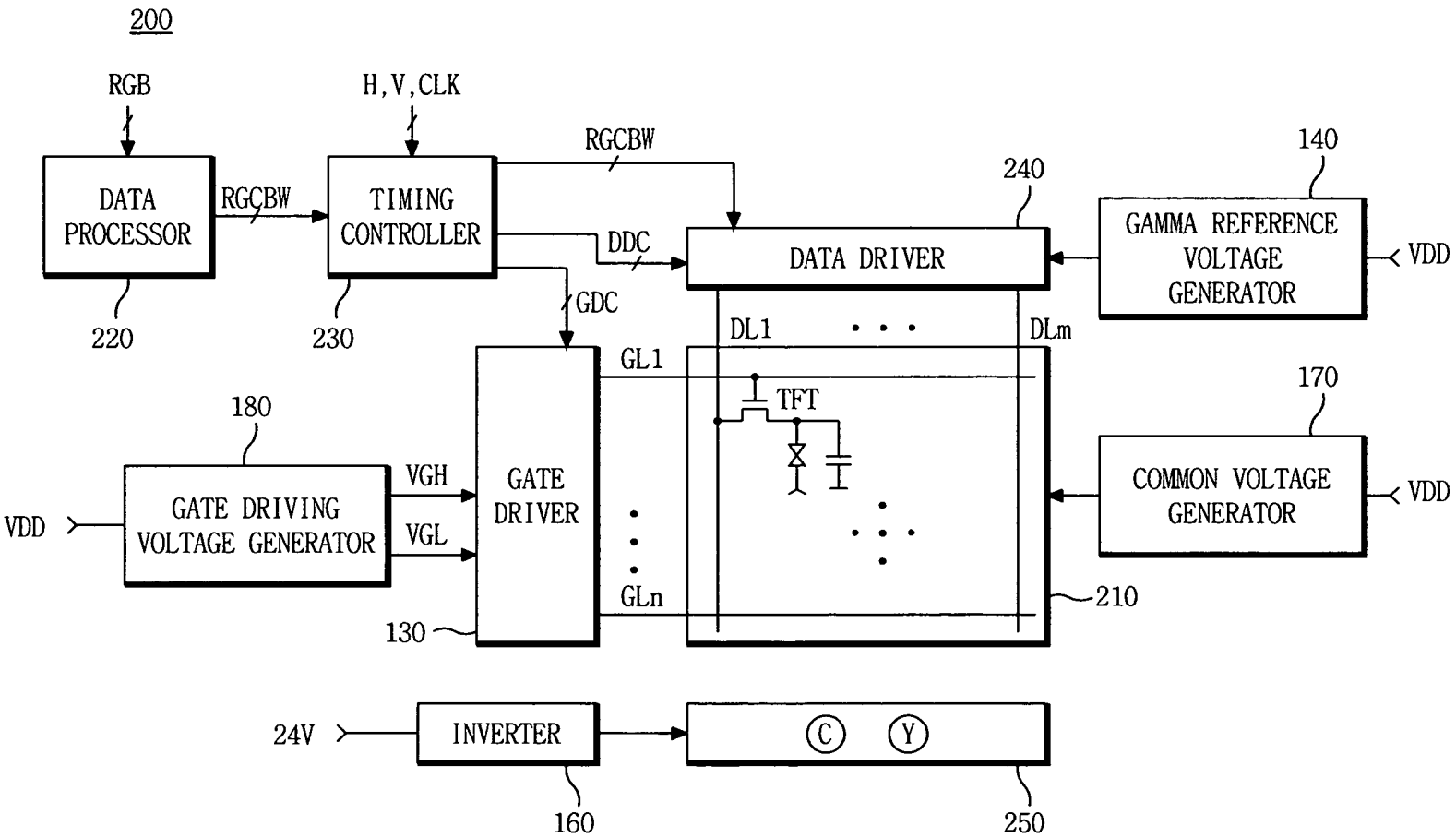
FIG. 3 is a block diagram showing a configuration of an LCD according to an embodiment of the present invention.

FIG. 3 is a block diagram showing a configuration of an LCD device according to an embodiment of the present invention. Referring to FIG. 3, an LCD device 200 includes a gate driver 130, a gamma reference voltage generator 140, an inverter 160, a common voltage generator 170, and a gate driving voltage generator 180 similar to the LCD device 100 shown in FIG. 1. The LCD device 200 further includes an LCD panel 210, a data processor 220, a timing controller 230, a data driver 240, and a backlight assembly 250. The LCD panel 110 has an upper glass substrate (not shown) and a lower glass substrate (not shown) facing each other, and a liquid crystal material is formed between the upper glass substrate and the lower glass substrate.

Figure 4A:
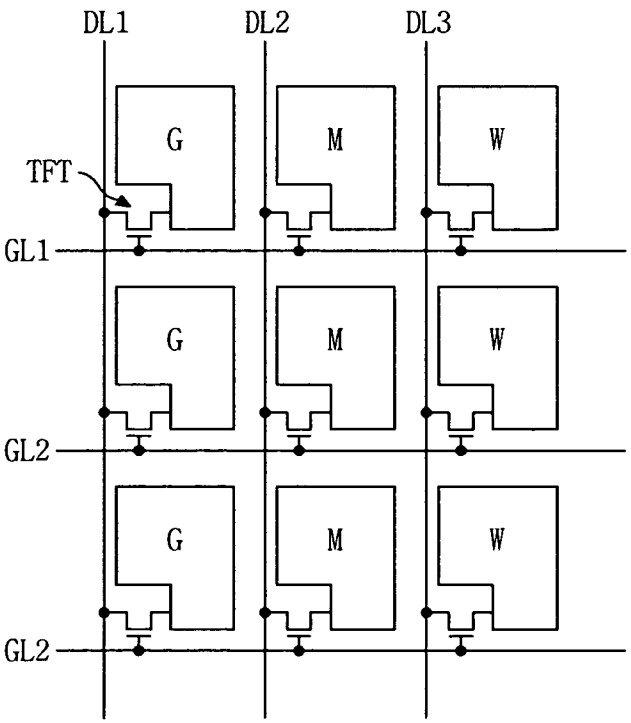
FIG. 4A shows a circuit diagram of exemplary sub-pixel regions in the LCD device of FIG. 3.

FIG. 4A shows a circuit diagram of exemplary sub-pixel regions in the LCD device of FIG. 3. Referring to FIG. 4A, data lines DL1 to DLm and gate lines GL1 to GLn cross each other on the lower glass substrate. Crossings of the data lines DL1 to DLm and the gate lines GL1 to GLn define pixel regions. Each pixel region is partitioned into a G sub-pixel, a W sub-pixel, and an M sub-pixel by forming G, W, and M color filters formed on the LCD panel 210. A TFT is formed at each of the G sub-pixel, the W sub-pixel, and the M sub-pixel, and the TFT supplies a data on the data lines DL1 to DLm to the liquid crystal cell Clc in response to a scanning pulse from the gate driver 130.

Figure 4B:
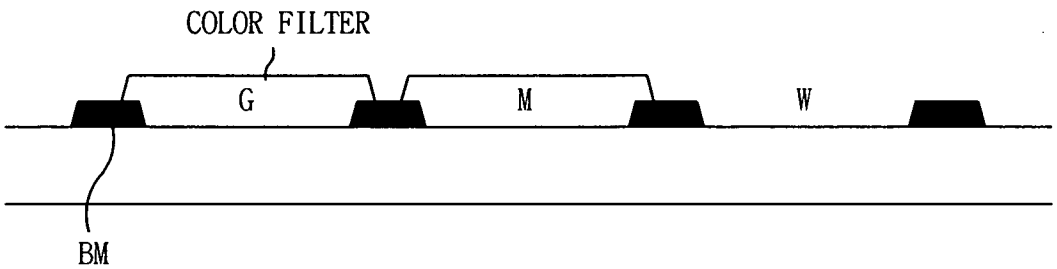
FIG. 4B shows a cross-sectional view of exemplary sub-pixel regions with colors and transparent filters according to an embodiment of the invention.
Figure 4C:
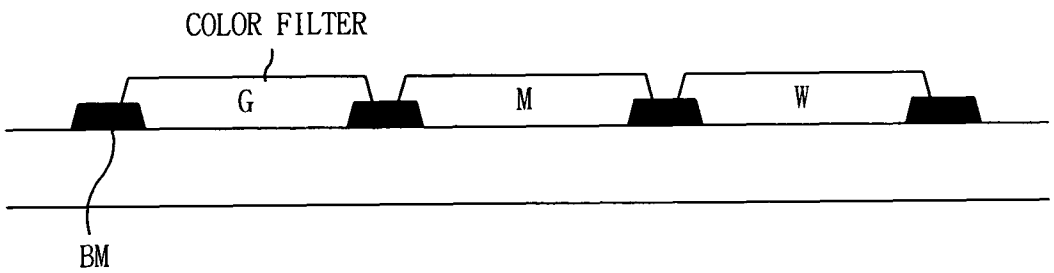
FIG. 4C shows a cross-sectional view of exemplary sub-pixel regions with colors and transparent filters according to another embodiment of the invention.

FIG. 4B shows a cross-sectional view of exemplary sub-pixel regions with colors and transparent filters according to an embodiment of the invention. FIG. 4C shows a cross-sectional view of exemplary sub-pixel regions with colors and transparent filters according to another embodiment of the invention. Referring to FIGS. 4B and 4C, the W sub-pixel is a transparent sub-pixel. As shown in FIG. 4B, color filters G and M are formed at corresponding sub-pixels of the color filter substrate with a black matrix BM separating the subpixels from each other. The W sub-pixel region does not include a filter. Similarly, as shown in FIG. 4C, color filters G and M are formed at corresponding sub-pixels of the color filter substrate with a black matrix BM separating the subpixels from each other. In contrast, in FIG. 4C, the W sub-pixel includes a transparent filter without any pigment in it with the common electrode (not shown) on the pigment-less transparent filter.

The data processor 220 converts three-color RGB data from a system into four-color RGCB data, and then calculates a gain from the four-color RGCB data. The data processor 220 amplifies a gray level of the four-color RGCB data in proportion to the calculated gain, and then calculates a minimum gray level of the amplified four-color RGCB data. The data processor 220 calculates an RGCB data using the calculated gain and the minimum gray level, and at the same time generates a W data having the calculated minimum gray level in each of the color components to output a digital RGCBW data to the timing controller 230.

Figure 4D:
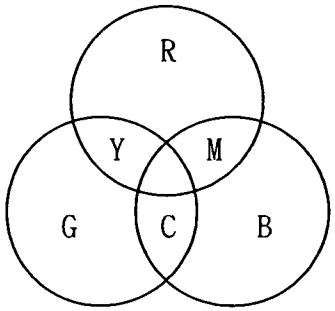
FIG. 4D shows a diagram of the interrelationship between R, G and B primary colors and C, Y and M colors.

FIG. 4D shows a diagram of the interrelationship between R, G and B primary colors and C, Y and M colors. Referring to FIG. 4D, the wavelengths of light corresponding to C fall between G and B. The wavelengths of light corresponding to M falls between R and B. The wavelength of light corresponding to Y falls between R and G. Thus, a C light passing through a G filter will emerge as a C light. In contrast, the C light passing through an M filter emerges as a B light. A Y light passing through a G filter emerges as a G light. In contrast, a Y light passing through an M filter emerges as a R light.

The timing controller 230 supplies the digital RGCBW data to the data driver 240, and at the same time generates a data driving control signal DDC and a gate driving control signal GDC using horizontal/vertical synchronizing signals H and V from a system in accordance with a clock signal CLK inputted from a system to supply them to the data driver 240 and the gate driver 130, respectively. Herein, the data driving control signal DDC includes a source shift clock SSC, a source start pulse SSP, a polarity control signal POL, and a source output enable signal SOE, etc., and the gate driving control signal GDC includes a gate start pulse GSP, a gate shift clock GSC, and a gate output enable signal GOE, etc.

The data driver 240 converts a digital RGCBW data inputted via the timing controller 230 into an analog RGCBW data in accordance with the timing controller 230 to supply it to the LCD panel 210 as follows. Each input frame is divided into first and second subframes to be sequentially displayed on the LCD panel. Accordingly, if the input frames are driven at a frequency of about 60 Hz, for example, the corresponding first and second subframes are driven at a frequency of about 120 Hz.

Figure 4E:
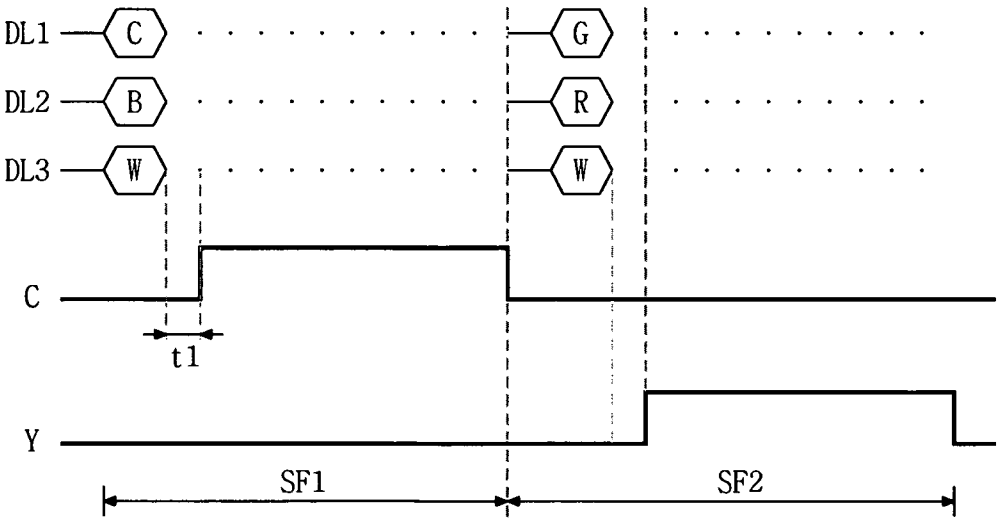
FIG. 4E is a waveform diagram showing a driving waveform of the LCD according to the embodiment of the present invention.

FIG. 4E is a waveform diagram showing a driving waveform of the LCD device according to an embodiment of the present invention. As shown in FIG. 4E, during the first subframe period, each pixel is irradiated with a C light from the backlight (not shown). If data from the first subframe is inputted from the timing controller 230, the data driver 240 supplies an analog C data and an analog B data to the G sub-pixel and the M sub-pixel, respectively, and supplies an analog W data to the W sub-pixel. Thus, during the first subframe period, the G sub-pixel transmits a light of C wavelength and the M sub-pixel transmits a light of B wavelength. Furthermore, the W sub-pixel transmits the C light from the backlight source substantially unchanged to increase a light transmittance.

During the second subframe period, each pixel is irradiated with a Y light from the backlight (not shown). If data from the second subframe is inputted from the timing controller 230, the data driver 240 supplies an analog G data and an analog R data to a G sub-pixel and an M sub-pixel, respectively, and supplies an analog W data to a W sub-pixel. During the second subframe period, the G sub-pixel transmits a light of G wavelength and the M sub-pixel transmits a light of R wavelength. Furthermore, the W sub-pixel transmits the Y light from the backlight source substantially unchanged to increase a light transmittance.

The backlight assembly 250 is radiated by a driving voltage and a current supplied from the inverter 160 to sequentially irradiate a C light and a Y light into the LCD panel 210 as follows. When driving the first subframe, a G sub-pixel and an M sub-pixel are supplied with an analog C data and an analog B data, respectively, and a W sub-pixel is supplied with an analog W data. Then, the backlight assembly 250 turns on a C light source to irradiates the C light onto the LCD panel 210. When driving the second subframe, a G sub-pixel and an M sub-pixel are supplied with an analog G data and an analog R data, respectively, and a W sub-pixel is supplied with an analog W data. Then, the backlight assembly 250 turns on a Y light source to irradiates the Y light into the LCD panel 210.

Figure 5:
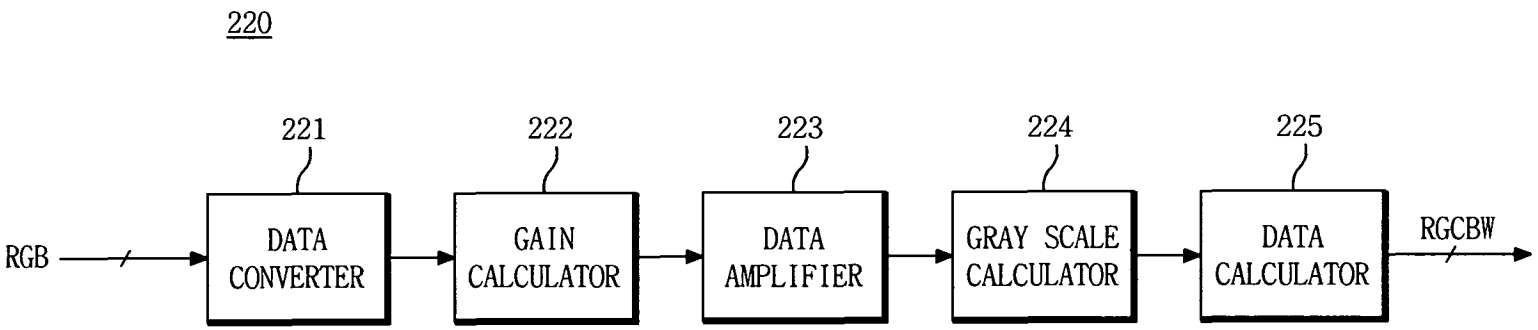
FIG. 5 is a block diagram showing a configuration of a data processor in FIG. 3.

FIG. 5 is a block diagram showing a configuration of the data processor in FIG. 3. Referring to FIG. 5, the data processor 220 includes a data converter 221, a gain calculator 222, a data amplifier 223, a gray level calculator 224, and a data calculator 225.

Figure 6A:
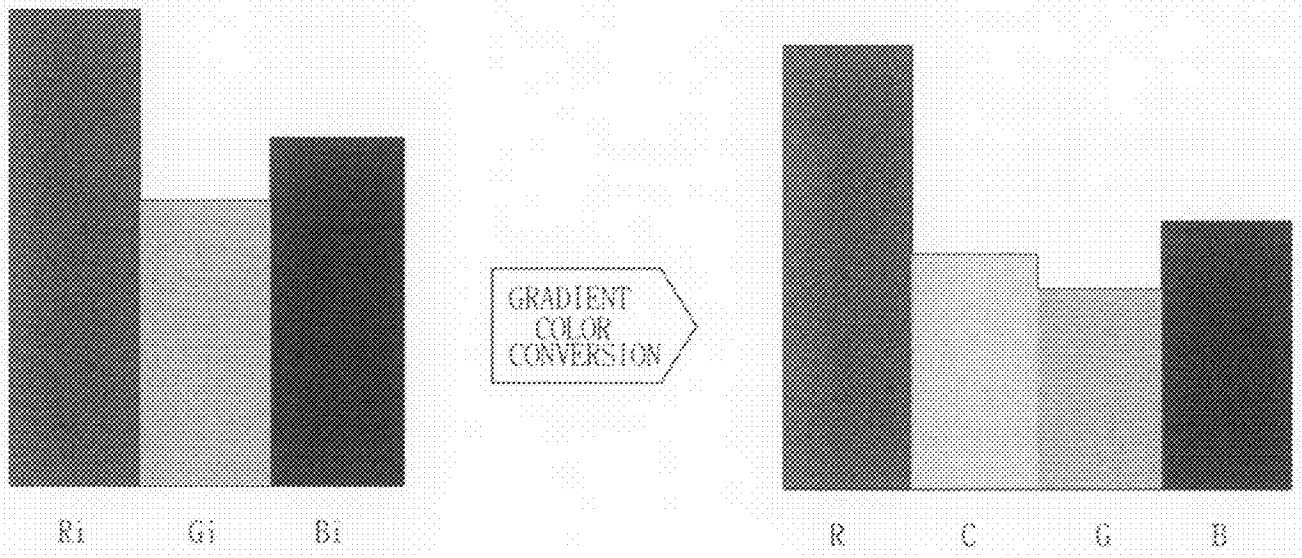
FIG. 6A to FIG. 6D are exemplary views explaining an operation of the data processor in FIG. 3 according to an embodiment of the invention.

FIG. 6A to FIG. 6D are exemplary views explaining an operation of the data processor in FIG. 3 according to an embodiment of the invention. Referring to FIG. 6A, the data converter 221 converts a three-color Ri, Gi, and Bi data from a system into a four-color RGCB data to output them to the gain calculator 222.

The gain calculator 222 calculates a maximum gray level GV1max and a minimum gray level GV1min of four-color RGCB data converted by the data converter 221, and then substitutes the maximum gray level GV1max and the minimum gray level GV1min in the following equation 1 to calculate a gain, thereby outputting it to the data amplifier 223.

$$\text{Gain}=(GV1\text{max}+GV1\text{min})/GV1\text{max} \quad \text{[Equation 1]}$$

As described above, the gain calculator 222 divides a value that the calculated maximum gray level GV1max and the minimum gray level GV1min are added, by the maximum gray level GV1max to calculate the share as a gain.

Figure 6B:
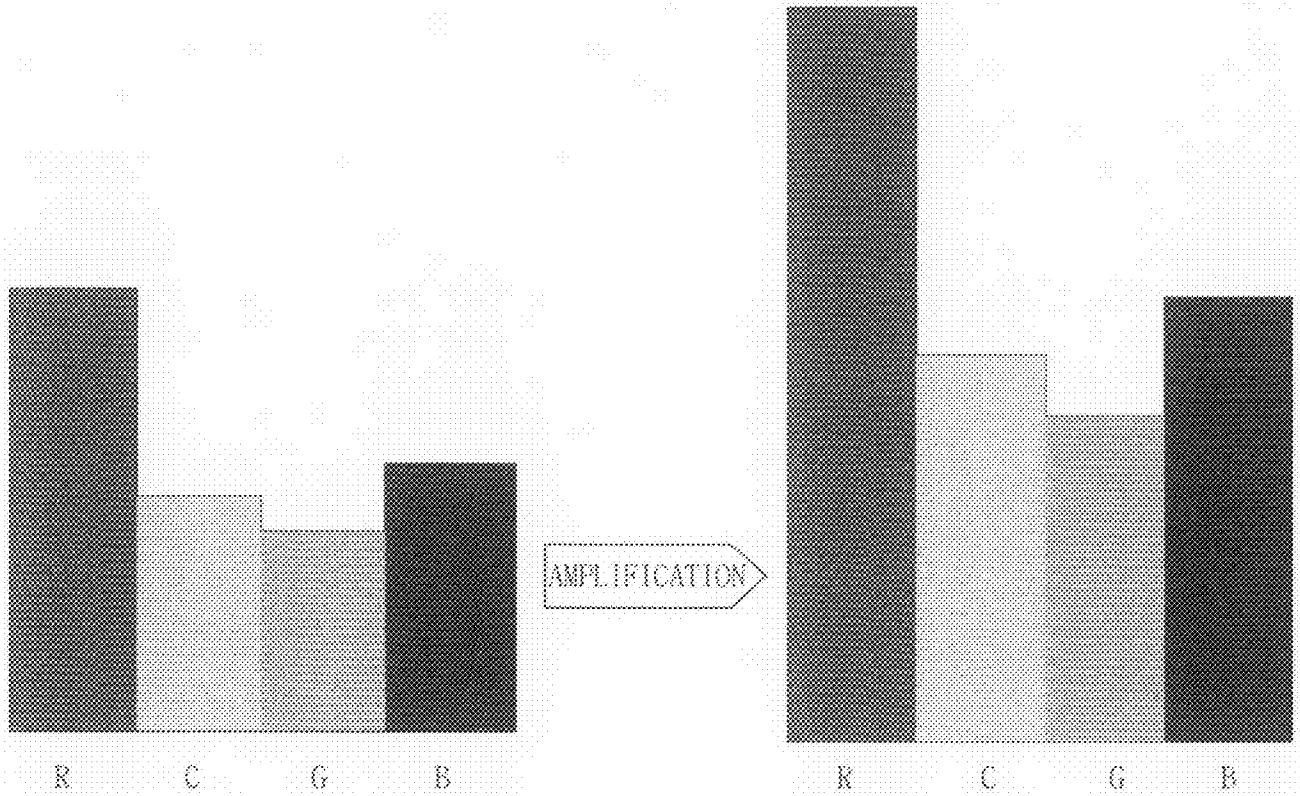

The data amplifier 223 multiplies a gray level of RGCB data by the calculated gain to amplify a gray level of RGCB data. In other words, the data amplifier 223 amplifies a gray level of RGCB data in proportion to the calculated gain as shown in FIG. 6B.

Figure 6C:
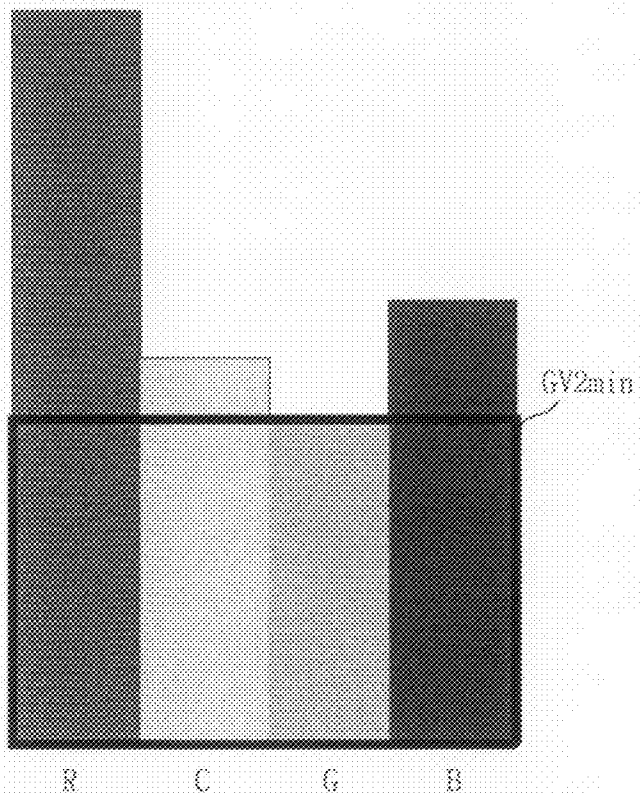
Figure 6D:
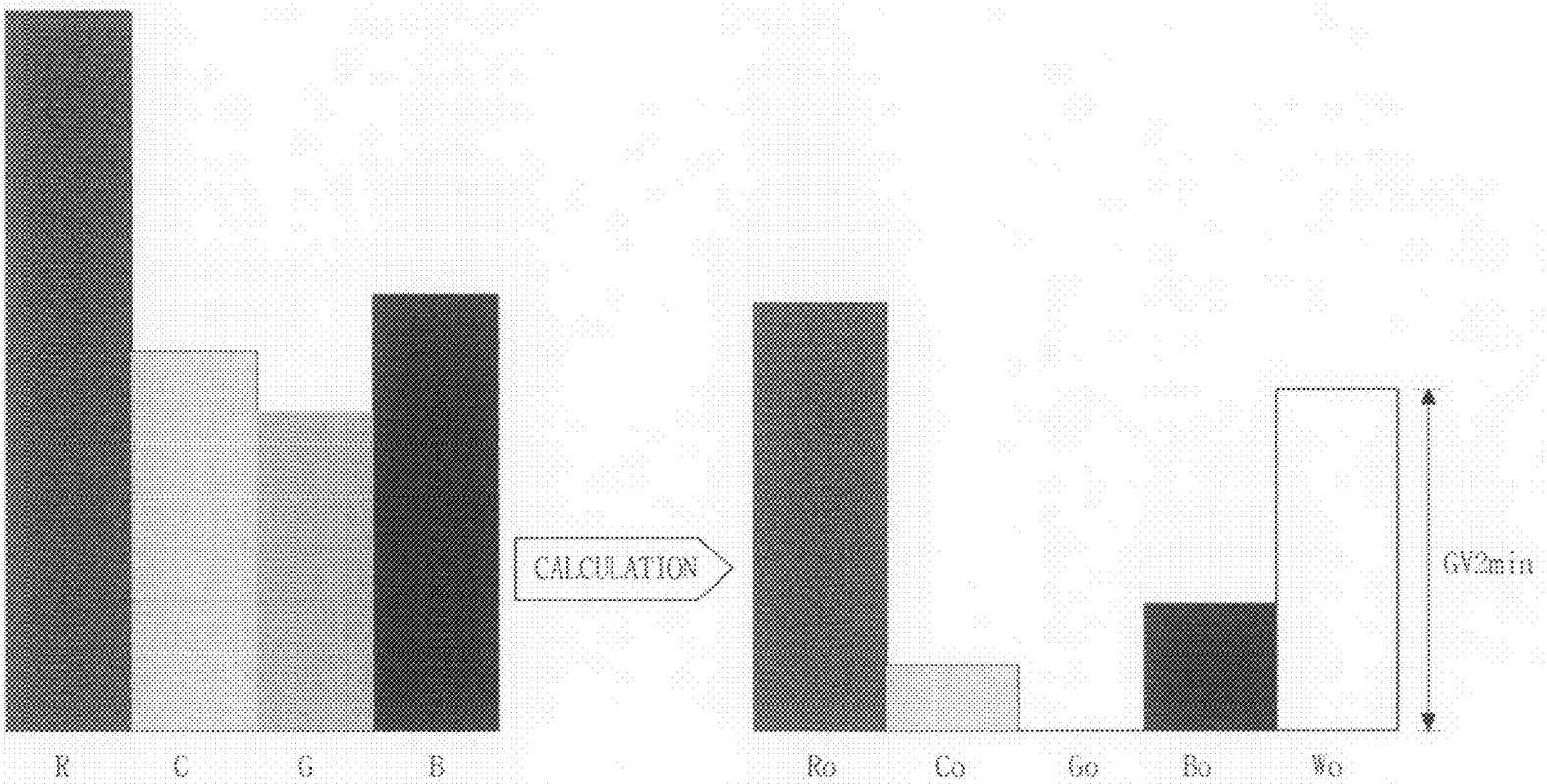

Referring to FIG. 6C, the gray level calculator 224 calculates a minimum gray level GV2min of four-color RGCB data amplified by the data amplifier 223 to output it to the data calculator 225. As shown in FIG. 6C, the amplified RGCB data can be interpreted as a combination of a first RGCB data (top portion of FIG. 6C) having a zero gray level value in the color component corresponding to the minimum gray level value (for example, the G component), and a second RGCB data (the boxed component at the bottom of FIG. 6C) with all four components having a gray level equal to the minimum gray level value GV2min. Accordingly, the second RGCB data corresponds to a W data having a gray level value of GV2min, as shown in FIG. 6D.

The data calculator 225 subtracts a minimum gray level GV2min calculated by the gray level calculator 224 from a gray level of RGCB data amplified by the data amplifier 223 to calculate a Ro, Go, Co, and Bo data to be outputted to the data output terminal, and generates a Wo data having a minimum gray level GV2min to output it to the data output terminal. More specifically, the data calculator 225 carries out a predetermined equation 2 to equation 5 to calculate an output Ro, Go, Co, and Bo data as shown in FIG. 6D. Furthermore, the data calculator 225 generates a Wo data having a minimum gray level GV2min calculated as shown in FIG. 6D.

$$Ro=(\text{gain}*R)-GV2\text{min} \quad \text{[Equation 2]}$$

As described above, the data calculator 225 subtracts a minimum gray level GV2min calculated by the gray level calculator 224 from a gray level of a R data amplified by the data amplifier 223 to calculate a Ro data.

$$Go=(\text{gain}*G)-GV2\text{min} \quad \text{[Equation 3]}$$

As described above, the data calculator 225 subtracts a minimum gray level GV2min calculated by the gray level calculator 224 from a gray level of a G data amplified by the data amplifier 223 to calculate a Go data.

$$Co=(\text{gain}*C)-GV2\text{min} \quad \text{[Equation 4]}$$

As described above, the data calculator 225 subtracts a minimum gray level GV2min calculated by the gray level calculator 224 from a gray level of a C data amplified by the data amplifier 223 to calculate a Co data.

$$Bo=(\text{gain}*B)-GV2\text{min} \quad \text{[Equation 5]}$$

As described above, the data calculator 225 subtracts a minimum gray level GV2min calculated by the gray level calculator 224 from a gray level of a B data amplified by the data amplifier 223 to calculate a Bo data.

Furthermore, there is a functional relation between a Wo data generated by the data calculator 225, and a maximum gray level GV2max and a minimum gray level GV2min of gray levels of RGCB data amplified by the data amplifier 223 as shown in the following equation 6.

$$Wo=f(GV2\text{max},GV2\text{min}) \quad \text{[Equation 6]}$$

Herein, "f" represents a function having a maximum gray level GV2max and a minimum gray level GV2min as a variable.

Figure 7A:
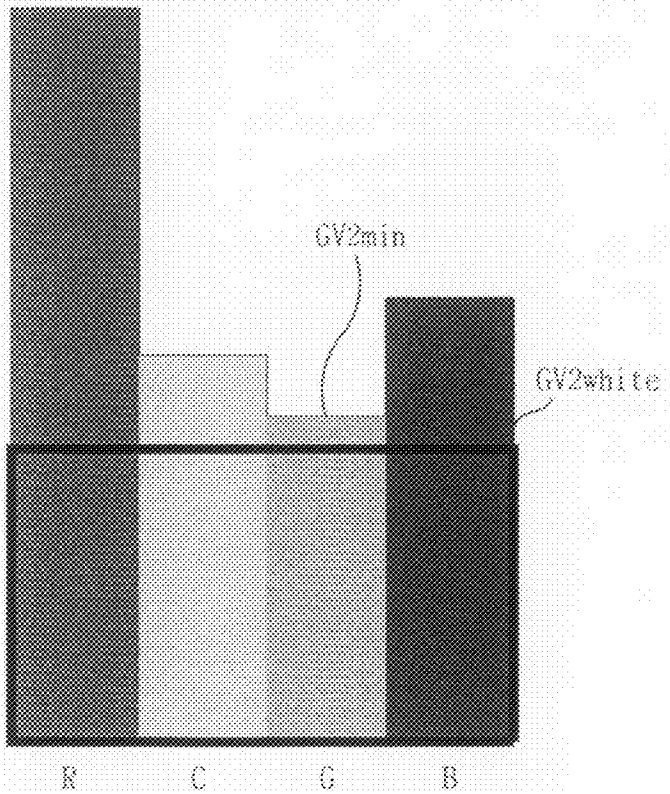
FIG. 7A to FIG. 7B are exemplary views explaining an operation of the data processor in FIG. 3 according to another embodiment of the invention.
Figure 7B:
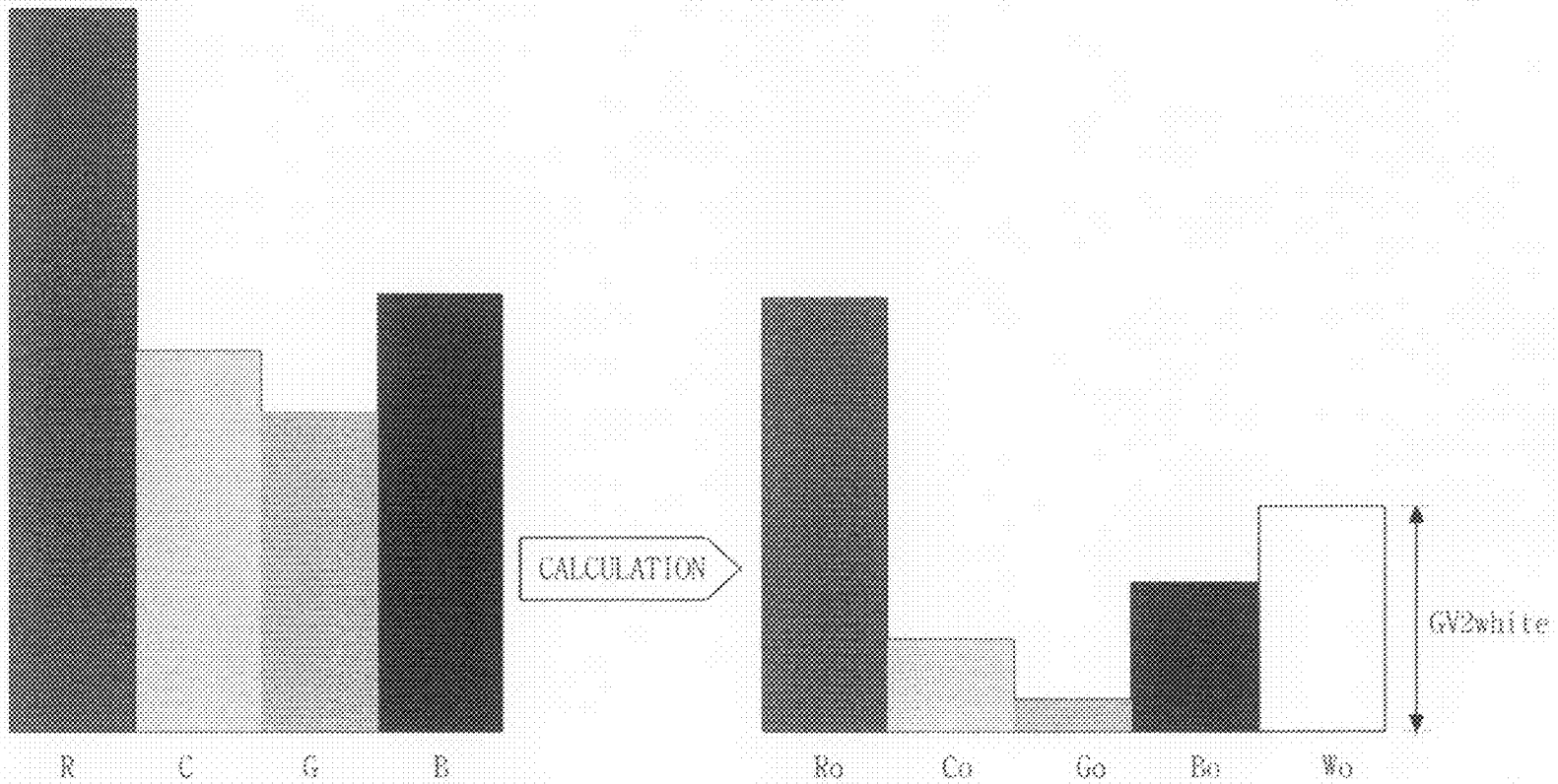

FIG. 7A to FIG. 7B are exemplary views explaining an operation of the data processor in FIG. 3 according to another embodiment of the invention.

Referring to FIG. 7A, the gray level calculator 224 calculates a minimum gray level GV2min of four-color RGCB data amplified by the data amplifier 223 to output it to the data calculator 225. As shown in FIG. 7A, the amplified RGCB data can be interpreted as a combination of a first RGCB data (top portion of FIG. 7A) having a non-zero gray level value in the color component corresponding to the minimum gray level value (for example, the G component), and a second RGCB data (the boxed component at the bottom of FIG. 7A) with all four components having a gray level value GV2white less than the minimum gray level value GV2min. Accordingly, the second RGCB data corresponds to a W data having a gray level value of GV2white, as shown in FIG. 7B.

The data calculator 225 subtracts a white gray level GV2white calculated by the gray level calculator 224 from a gray level of RGCB data amplified by the data amplifier 223 to calculate a Ro, Go, Co, and Bo data to be outputted to the data output terminal, and generates a Wo data having the white gray level GV2white to output it to the data output terminal. Furthermore, the data calculator 225 generates a Wo data having the gray level GV2white calculated as shown in FIG. 7B.

$$Ro=(\text{gain}*R)-GV2\text{white} \quad \text{[Equation 7]}$$

As described above, the data calculator 225 subtracts the white gray level GV2white calculated by the gray level calculator 224 from a gray level of a R data amplified by the data amplifier 223 to calculate a Ro data in accordance with Equation 7.

$$Go=(\text{gain}*G)-GV2\text{white} \quad \text{[Equation 8]}$$

As described above, the data calculator 225 subtracts the white gray level GV2white calculated by the gray level calculator 224 from a gray level of a G data amplified by the data amplifier 223 to calculate a Go data in accordance with Equation 8.

$$Co=(\text{gain}*C)-GV2\text{white} \quad \text{[Equation 9]}$$

As described above, the data calculator 225 subtracts the white gray level GV2white calculated by the gray level calculator 224 from a gray level of a C data amplified by the data amplifier 223 to calculate a Co data in accordance with Equation 9.

$$Bo=(\text{gain}*B)-GV2\text{white} \quad \text{[Equation 10]}$$

As described above, the data calculator 225 subtracts the white gray level GV2white calculated by the gray level calculator 224 from a gray level of a B data amplified by the data amplifier 223 to calculate a Bo data in accordance with Equation 10.

As described above, the present invention calculates a W data through the above-mentioned process to increase a light transmittance, and calculate a white data without distorting an R color, a G color, a C color, and a B color.

It will be apparent to those skilled in the art that various modifications and variations can be made in the liquid crystal display device and method of driving the same of embodiments of the present invention. Thus, it is intended that embodiments of the present invention cover the modifications and variations of the embodiments described herein provided they come within the scope of the appended claims and their equivalents.

What is claimed is:

1. A liquid crystal display device, comprising:

a converter for converting a three-color pixel data into a converted data;

an amplifier for amplifying the converted data;

a first calculator for generating a four-color pixel data comprising:

a zero gray level value in one of the four colors;

a non-zero gray level value in the remaining three colors; and a white data having a non-zero white gray level value equal to a minimum gray level in each of the amplified converted four colors; and a controller for partitioning the four-color pixel data into:

first and second data to be applied to green and magenta sub-pixels of a display panel, respectively, during a first part of a display period; and third and fourth data to be applied to the green and the magenta sub-pixels, respectively, during a second part of the display period, the controller applying the white data to a white sub-pixel of the display panel during the first and second parts of the display period, wherein the first, the second, the third, and the fourth data represent cyan, the blue, the green, and the red data, respectively, and wherein the first display period is irradiated with cyan light, and the second display period is irradiated with yellow light.

2. The liquid crystal display device of claim 1, further comprising a processor for converting the three-color pixel data into the four-color pixel data and the white data.

3. The liquid crystal display device of claim 1, further comprising a second calculator for calculating a gain in accordance with a maximum gray level and the minimum gray level of the four colors.

4. The liquid crystal display device of claim 3, wherein the gain is a fraction of the summation of the maximum and minimum gray levels.

5. The liquid crystal display device of claim 1, wherein each of the first, second, third, and fourth data is generated from the amplified converted data by subtracting the white gray level from each of the four colors of the amplified converted data.

6. The liquid crystal device of claim 1, further comprising a backlight including first and second sources for projecting:

a first light having a first wavelength onto the first and second sub-pixels during the first part of the display period; and a second light having a second wavelength onto the first and second sub-pixels during the second part of the display period.

7. The liquid crystal display device of claim 6, wherein:

the first light includes cyan light; and the second light includes yellow light.

8. The liquid crystal display device of claim 1, further comprising a display panel including one or more pixels partitioned into the first, the second, and the third sub-pixels.

9. The liquid crystal display device of claim 8, wherein the first, second, and third sub-pixels include green, magenta, and transparent filters, respectively.

10. A method of driving a liquid crystal display device including a display panel with one or more pixel region partitioned into first, second, and third sub-pixels, the method comprising:

converting an input three-color pixel data into a converted data;

amplifying the converted data;

generating a white data having a non-zero white gray level value equal to a minimum gray level in each of four colors from the amplified converted data;

generating a four-color pixel data by subtracting the white gray level value from each of the four colors of the amplified converted data;

displaying the four-color pixel data and the white data on the display panel, partitioning the four-color pixel data into first, second, third, and fourth data;

applying the first and second data to green and magenta sub-pixels, respectively, and the white data to the white sub-pixel during a first part of a display period; and applying the third and fourth data to the green and magenta sub-pixels, respectively, and the white data to the white sub-pixel during a second part of the display period, wherein the generated four-color pixel data has a zero gray level value in one of the four colors, and a non-zero gray level value in the remaining three colors, and wherein the first, the second, the third and the fourth data represent cyan, blue, green, and red data, respectively, and wherein the first display period is irradiated with cyan light, and the second display period is irradiated with yellow light.

11. The method of claim 10, further comprising projecting a first light having a first wavelength onto the first, second, and third sub-pixels during the first part of the display period and a second light having a second wavelength onto the first, second, and third sub-pixels during the second part of the display period.

* * * * *